United States Patent [19]

Ghiardo

[11] Patent Number: 4,865,085

[45] Date of Patent: Sep. 12, 1989

[54] WEFT FEEDING DEVICE FOR WEAVING LOOMS

[75] Inventor: Fiorenzo Ghiardo, Vigliano Biellese, Italy

[73] Assignee: ROJ Electrotex S.P.A., Biella, Italy

[21] Appl. No.: 169,148

[22] Filed: Mar. 10, 1988

Related U.S. Application Data

[63] Continuation of Ser. No. 840,954, Mar. 17, 1986, abandoned.

[30] Foreign Application Priority Data

Apr. 22, 1985 [IT] Italy ..... 20436 A/85

[51] Int. Cl.[4] ..... D03D 47/36; G01N 21/88

[52] U.S. Cl. ..... 139/452; 242/47.01; 242/47.12; 356/429

[58] Field of Search ..... 139/452, 1 B; 242/47.01, 47.12, 47.13; 356/24, 238, 429, 438, 439

[56] References Cited

U.S. PATENT DOCUMENTS

| | | | |
|---|---|---|---|
| 3,455,341 | 7/1969 | Pfarrwaller et al. | 139/452 |
| 3,907,440 | 9/1975 | Eichenberger et al. | 356/429 |
| 4,132,368 | 1/1979 | Schiess et al. | 139/452 |
| 4,298,172 | 11/1981 | Hellstrom | 139/452 |
| 4,405,234 | 9/1983 | Juaire | 356/239 |
| 4,429,723 | 2/1984 | Maroino | 139/452 |
| 4,529,017 | 7/1985 | Suzuki et al. | 139/452 |
| 4,638,840 | 1/1987 | Ghiardo et al. | 139/452 |

FOREIGN PATENT DOCUMENTS

| | | | |
|---|---|---|---|
| 0164032 | 12/1985 | European Pat. Off. | 242/47.01 |
| 0164033 | 12/1985 | European Pat. Off. | 242/47.01 |

*Primary Examiner*—Harvey C. Hornsby
*Assistant Examiner*—Joseph S. Machuga
*Attorney, Agent, or Firm*—Young & Thompson

[57] ABSTRACT

A weft feeding device for weaving looms regulates the motor speed, according to the amount of yarn wound on the drum at least two photoelectric cells (11, 12) are provided one of which (11) checks the amount of yarn (3) wound on the drum (1), while the other (12) measures the transparency of the protection glass (15) provided on the cells. These photoelectric cells (11, 12) cooperate with an electronic circuit, which processes their signals (31, 32) in order to automatically compensate the transparency variations in the protection glass (15), thereby allowing a more uniform regulation of the motor speed of the weft feeding device.

3 Claims, 3 Drawing Sheets

WEFT FEEDING DEVICE FOR WEAVING LOOMS

This application is a continuation of application Ser. No. 840,954, filed 3/17/86 now abandoned.

BACKGROUND OF THE INVENTION

The object of the present invention is to provide important improvements in weft feeding devices for weaving looms, of the type in which the drum around which the weft yarn winds to form a reserve is held stationary, and the turns of said reserve are wound thereon by a rotating reel and are moved forward, mutually spaced, by suitable means.

As is known, it is important in such weft feeding devices to be able to easily check the yarn reserve being wound on the drum and to automatically regulate the winding speed of the turns of said reserve, according to the amount of yarn drawn from the loom.

On weft feeding devices with advancement by adjacent turns, the yarn reserve can be easily checked by using photoelectric cells fixedly connected to the body of the device. These sensors generally comprise a sending element and a receiving element, positioned so that the luminous beam sent by the first element can be received by the second element through reflection from a reflecting element on the winding drum. The presence of yarn reduces the amount of light reflected by the reflecting element positioned on the winding drum, consequently varying the electric signal generated by the receiving element. Said signal can be conveniently used as a pilot signal to run the motor at the desired speed.

On weft feeding devices with advancement by spaced turns (this type of device is preferred, as it allows obtaining a more uniform tension in the various turns being wound, thereby making the evenness of the reserve less strictly tied, than in weft feeding devices with advancement by adjacent turns, to the various motor speeds), it has up to date not been possible to read and check the yarn reserve with the previously described photoelectric methods, because of the considerable spacing between the turns, which makes the operation unsteady and unreliable, especially due to the possible presence of dust gradually settling on the transparent protection element—made of glass or other material—which delimits the optical member of the photoelectric cells.

U.S. Pat. No. 4,638,840 proposes to cause the turns gradually to approach each other, until they become adjacent close to the outlet end of the winding drum. This overcomes the heretofore mentioned difficulties, by operating as in the previously specified arrangement with adjacent turns; nonetheless, especially when working with fine yarns, this arrangement again involves the drawbacks of weft feeding devices with advancement by adjacent turns (particularly the possible overlapping of the turns).

SUMMARY OF THE INVENTION

To avoid all these drawbacks, the present invention thus provides for a weft feeding device with advancement by spaced turns, wherein the turns may gradually draw close to each other while moving forward along the drum, without however becoming adjacent, and wherein it is possible to use photoelectric cells, so as to fully guarantee a uniform regulation of the motor speed, even in dusty environments as those connected with weaving.

Such a weft feeding device —of the type wherein a rotating reel winds a reserve of yarn turns around a drum held stationary, and comprising means to move forward said turns on the drum, keeping them mutually spaced, and means to regulate the motor speed according to the amount of yarn wound on the drum —is characterized in that, said means to regulate the motor speed comprise at least two photoelectric cells with protection glass, aligned and spaced apart along in the direction of the drum axis, the luminous beams sent by said cells being reflected by a reflecting element fixed on the surface of said drum, and in that, while the first photoelectric cell positioned towards the inlet of the yarn checks in known manner the amount of yarn wound on the drum, the second cell positioned towards the outlet of the yarn measures the transparency of said protection glass, both photoelectric cells cooperating with an electronic circuit in order to automatically compensate the transparency variations in said glass.

BRIEF DESCRIPTION OF THE DRAWINGS

The invention will now be described in further detail, with reference to the accompanying drawings, in which.

DESCRIPTION OF THE PREFERRED EMBODIMENT

Figure 1:
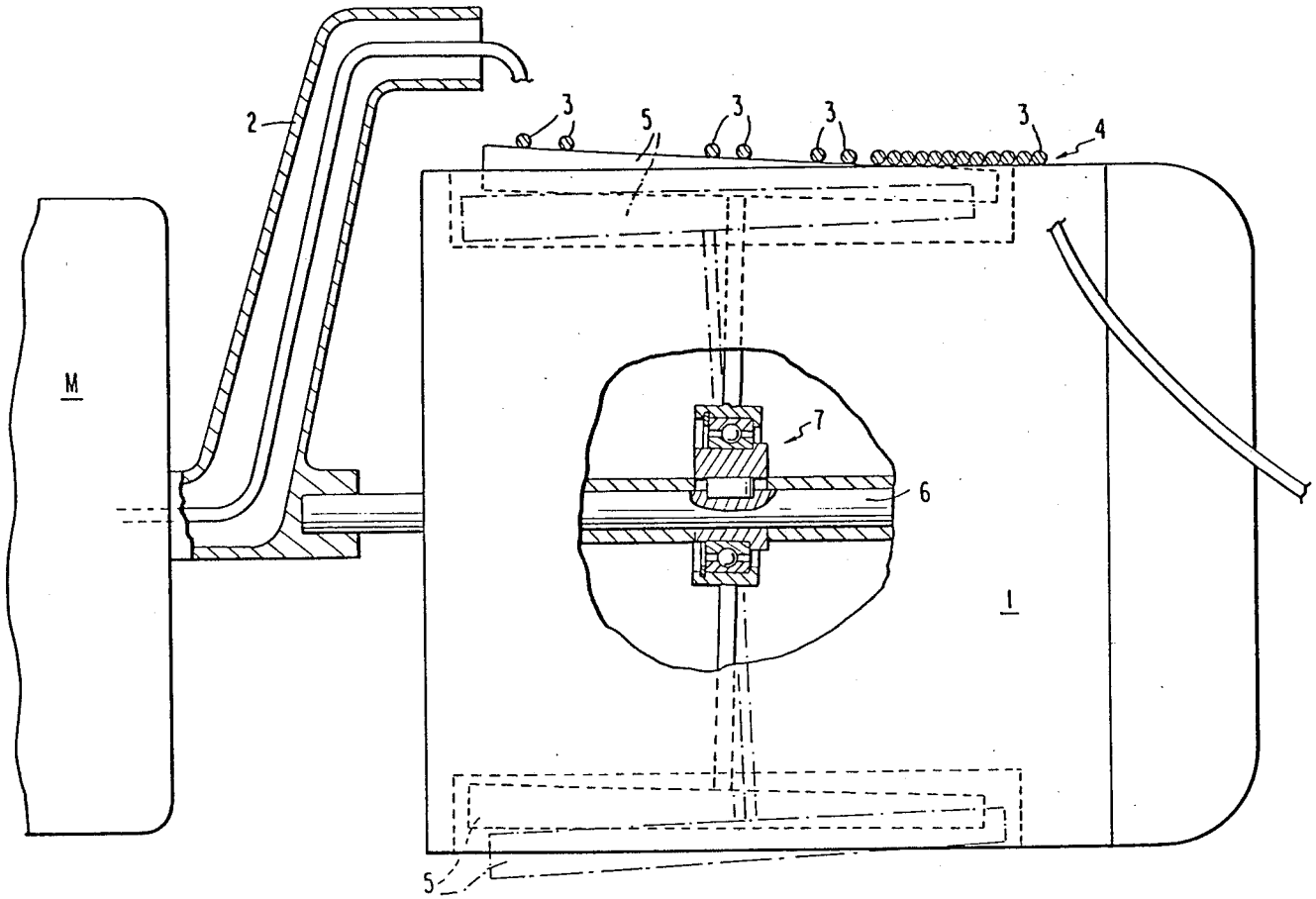
FIG. 1 is a diagrammatic view of a weft feeding device, of the type with drum held stationary and advancement of the yarn reserve turns, to which the present invention is applied.

With reference to the drawings, in a weft feeding device having a drum 1 held stationary, a rotating reel 2 winds turns of weft yarn 3 on said drum 1 in order to form a reserve 4.

The advancement of the turns 3 is obtained, in known manner, by means of a plurality of columns 5, partially and variably emerging from the periphery of the drum 1 thanks to the motion imparted thereon by the driving shaft 6 driven by motor M of the weft feeding device, in respect of which said columns are rotatably mounted by way of a support 7 comprising a skew bushing and a rotary bearing. Each column 5 is tapered towards the outlet or discharge end of the weft feeding device, whereby its profile is inclined in respect of the drum cylindrical surface, into appropriate seats of which said columns are housed with no possibility of rotation. In this way, the columns variably emerge along the drum axis, decreasingly spacing apart the turns 3 as they move forward from the inlet end of the drum, close to the reel 2, towards the opposite outlet end of said drum. Thus, as shown in the drawings, the distribution of the turns is such that they are separate and spaced relatively far apart in the initial part of the drum 1, while they gradually draw close to each other in the final part of the drum. With fine weft yarns, the turns 3 will still be spaced apart even towards the outlet end of the drum, whereas with thicker yarns the turns will be adjacent.

This arrangement of the turns, besides the advantage of making the tension in said turns more uniform, allows a considerable yarn reserve, thereby notably limiting the acceleration of the electric motor while winding a new reserve; the weft feeding device can thus eminently perform its storage function between the reel and the loom.

Figure 2:
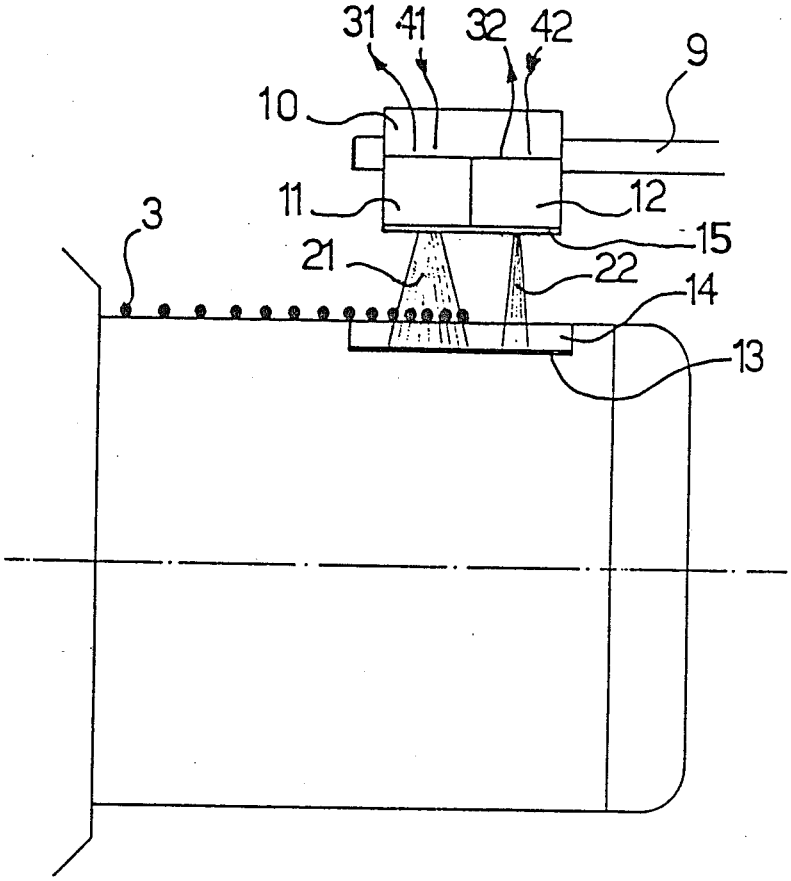
FIG. 2 is an axial section view, showing the positioning of the photoelectric cells in respect of the drum, in a weft feeding device according to the invention, as that shown in FIG. 1.

According to the invention, in order to obtain such an arrangement of the yarn reserve, use is made of at least two photoelectric cells 11 and 12, fixedly mounted onto a same support 10, as shown in FIG. 2. The support 10, with the two photoelectric cells 11 and 12, can move axially by sliding on guides 9. The photoelectric cell 11 generates a luminous beam 21, while the photoelectric cell 12 generates a luminous beam 22. Both luminous beams are reflected towards the respective photoelectric cells by a reflecting element 13, preferably consisting of a reflecting strip protected by a suitable glass 14 and positioned along the drum axis towards the outlet end.

The surface of the glass 14 slightly projects in respect of the drum columns, so that the turns 3, while moving forward, slightly skim the surface of said glass, preventing dust from settling thereon.

The luminous beam 21 strikes an area of the reflecting element 13 which precedes by a few millimeters the area struck by the luminous beam 22, this latter area being closer to the outlet end of the drum. In this way, the beam 21 is intercepted by the advancing turns 3 previously to the beam 22. Moreover, the luminous beam 21 is preferably wider than the luminous beam 22.

The luminous beams reflected from the reflector 13 respectively generate two signals 31 and 32.

Figure 3:
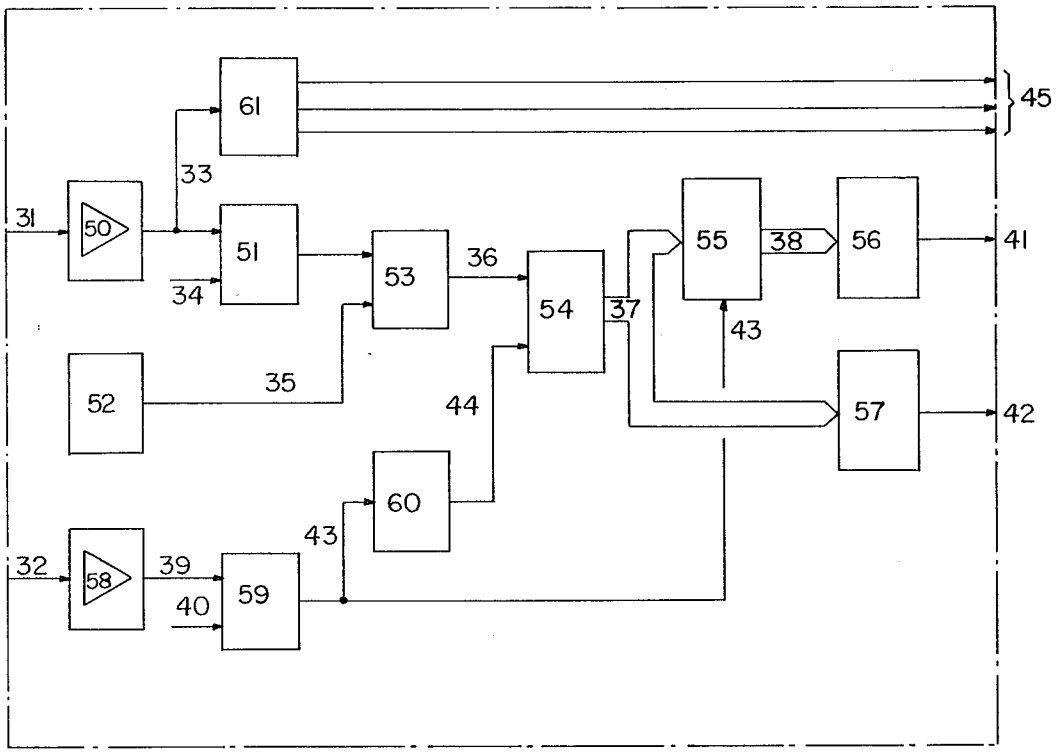
FIG. 3 is the block diagram of the electronic monitoring circuit with which said photoelectric cells cooperate to achieve the objects of the invention.

In the absence of a yarn reserve, the luminous beam 21 generates a signal 31 which, suitably processed in known manner by the electronic circuit of FIG. 3, runs the motor of the weft feeding device at full speed. As the turns 3 move forward, some of them start to partly cover the beam 21, modifying the signal 31; the motor speed will thus be gradually reduced, up to stopping.

The photoelectric cells 11 and 12 are protected from dust by a glass 15. During working of the weft feeding device, dust will inevitably settle gradually onto the glass 15, which will absorb part of the light of the two beams. This reduction of the luminous flux would be wrongly interpreted by the electronic circuit, as a presence of yarn turns - thereby determining an error in the running of the motor - if it were not for the arrangement according to the invention. In fact, to eliminate this drawback, said arrangement uses the formation provided by the luminous beam 22 as a reference to allow an automatic rating of the luminous beam 21.

It is to be noted that, during normal working of the weft feeding device, the luminous beam 22 is free from the presence of yarn turns during several time intervals. The electronic circuit of FIG. 3 uses these time intervals to measure the amount of light reflected by the beam 22 and to consequently dose the amount of light sent by the beam 21, in order to compensate any light which may have been absorbed by the dust settled on the protection glass 15.

With reference to FIG. 3, which illustrates the block diagram of an electronic circuit adapted to provide the aforespecified automatic compensation, the signal 31, amplified and processed by the amplifier 50, generates a signal 33 which operates an inverter circuit 61. This latter generates a three-phase voltage 45 with variable frequency and voltage, in order to run the motor which operates the rotating reel 2. The signal 33 is moreover compared with a reference value 34 in comparator 51. When the signal 33 exceeds the reference value 34 the luminous beam 22 is positively not influenced by the presence of a reserve, as said reserve will first have to intercept the beam 21, determining a reduction of the signal 33 below the reference value 34.

An oscillator 52 generates a square wave 35 of suitable frequency. An AND-circuit 53 allows the signal 35 to pass only if the output from the comparator 51 is at a high logic level, which occurs only if the signal 33 is higher than the reference value 34. Consequently, the signal 36 will be formed with a train of pulses, which are present only when the beam 21 has not yet been fully covered by the yarn reserve, whereby the beam 22 is still not influenced by the presence of yarn.

The binary counter 54 will be increased each time a pulse reaches the signal 36. The binary output 37 from the counter 54 is converted into an analog signal 42 by the converter 57. The signal 42 determines the amount of light sent by the photoelectric cell 12. The increase of the counter 54 thus increases the flux of the luminous beam 22 and consequently the signal 32. This signal, suitably amplified by the circuit 58, is compared with a reference value 40 by means of a comparator 59.

When the signal 39 reaches the reference value 40, the signal 43 takes up a high logic level which is used to store, in the memory 55, the binary value present at the output from the counter 54. A converter 56 converts the value stored in 55 into an analog signal 4 which determines the amount of light sent by the photoelectric cell 11. The signal 43 now generates, through the delay line 60, a delayed pulse 44 which zeroizes the value of the counter 54, thereby starting a new cycle.

The increasing presence of dust on the glass 15 will determine the requirement to reach increasingly high values on the counter 54, so that the signal 39 may reach the threshold value 40, whereby the values stored in 55 will be always higher and the light sent by the photoelectric cell 11 - in order to compensate the loss of luminosity, due to dust settling on the glass 15 - will consequently be brighter.

To be sure that the transparency of the protection glass, measured by the second photoelectric cell 12, is actually equal to that corresponding to the first cell 11 (thereby to avoid errors, which might derive from an uneven distribution of the dust or like on the glass, or from improper cleaning of the same during maintenance), the luminous beams 21 and 22 of the two photoelectric cells 11 and 12, can be caused to emerge through a common area of said protection glass, by positioning the two photoelectric cells inclined in such a way that the beams emerging therefrom correspondence cross each other exactly in correspondence said area.

The information on the degree of dirt on the glass 15 can also be used to warn the operator - for instance through a signal light - of the need to clean said protection glass.

Another embodiment of the invention provides for the presence of two photoelectric reading cells, instead of one only, as in the aforespecified example. This allows using a wider luminous beam for thicker yarns and a narrower luminous beam for finer yarns, thereby making it easier to check the presence of a yarn reserve. A suitable external control (commutator) allows the operator to choose the photoelectric cell which is most suited to the type of yarn being woven.

An external commutator could additionally be provided to choose the maximum rotation speed of the motor, so as to be able to reach the best possible compromise between a constant speed of the motor and the alternate drawing of yarn from the loom.

It is to be understood that the heretofore described and illustrated embodiment of the invention is a mere example and that modifications thereof, as well as other embodiments are possible, without departing from the scope of the invention itself.

I claim:

1. Weft feeding device for weaving looms, comprising a rotating reel that winds a reserve of yarn turns around a stationary drum having an axis, means to move forward said turns on the drum, keeping them mutually spaced, and means to regulate the speed of a motor of said device according to the amount of yarn wound on the drum, said means to regulate the motor speed comprising at least first and second photoelectric cells (11, 12) with protection glass (15) exposed to the yarn on the drum, aligned and spaced apart in the direction of the axis of the drum (1), both of the luminous beams (21, 22) sent by said cells (11, 12) shining through said protection glass (15) and both of said beams (21, 22) being reflected by a reflecting element (13) fixed on the surface of the drum (1), the first photoelectric cell (11) being positioned towards the point the yarn (3) first contacts the drum and checking the amount of yarn (3) wound on a first region of the drum (1) while the second photoelectric cell (12), positioned towards the point the yarn (3) leaves the drum, measures the transparency of said protection glass (15) in a second region of the drum free from yarn, said first and second regions being disposed on opposite axial sides of said point the yarn leaves the drum, both photoelectric cells (11, 12) cooperating with an electronic circuit in order to automatically compensate the transparency variations in said glass (15) so as to vary the speed of a said motor independently of said transparency variations.

2. Weft feeding device as in claim (1), wherein said photoelectric cells (11, 12) are mounted a support (10) which is slidable in the direction of the axis of the drum (1).

3. Weft feeding device as i claim 1, wherein the luminous beam (21) of the first photoelectric cell (11) is wider than the luminous beam (22) of the second photoelectric cell (12).

* * * * *